US007993039B2

(12) United States Patent
Nankil et al.

(10) Patent No.: US 7,993,039 B2
(45) Date of Patent: Aug. 9, 2011

(54) LIGHTING FIXTURE HAVING A LATCHING SYSTEM AND AN AUXILIARY EMERGENCY LIGHT

(75) Inventors: Robert R. Nankil, Buena Park, CA (US); Nora N. Onofrio, Long Beach, CA (US)

(73) Assignee: Hubbell Incorporated, Shelton, CT (US)

( * ) Notice: Subject to any disclaimer, the term of this patent is extended or adjusted under 35 U.S.C. 154(b) by 315 days.

(21) Appl. No.: 12/385,011

(22) Filed: Mar. 27, 2009

(65) Prior Publication Data

US 2010/0246194 A1 Sep. 30, 2010

(51) Int. Cl.
*F21V 11/00* (2006.01)
*F21S 8/00* (2006.01)

(52) U.S. Cl. ..... 362/368; 362/191; 362/298; 362/374; 362/396; 362/432

(58) Field of Classification Search ..... 362/191, 362/298, 368, 374, 396, 432
See application file for complete search history.

(56) References Cited

U.S. PATENT DOCUMENTS

| | | | | |
|---|---|---|---|---|
| 543,730 | A | 7/1895 | Heap | |
| 1,883,803 | A | 10/1929 | Martin, Jr. | |
| 3,007,038 | A | 10/1961 | Anisfield | |
| 3,075,073 | A | 1/1963 | Hildebrecht | |
| 3,183,343 | A | 5/1965 | Blum | |
| 3,328,579 | A | 6/1967 | Green | |
| 3,531,637 | A * | 9/1970 | Nathanson | 362/186 |
| 3,805,055 | A | 4/1974 | Cassey | |
| 3,833,804 | A | 9/1974 | Vesely | |
| 4,028,541 | A * | 6/1977 | Franklin | 362/307 |
| D264,136 | S | 4/1982 | Castiglioni | |
| 4,394,718 | A | 7/1983 | Balzer | |
| 4,646,211 | A | 2/1987 | Gallant et al. | |
| D302,333 | S | 7/1989 | Mason | |
| 4,969,073 | A | 11/1990 | Isenga | |
| 4,969,074 | A | 11/1990 | Davis et al. | |
| 5,105,347 | A | 4/1992 | Ruud et al. | |
| 5,121,309 | A | 6/1992 | Ewing et al. | |
| 5,134,550 | A | 7/1992 | Young | |
| D344,359 | S | 2/1994 | Matos | |
| 5,384,694 | A | 1/1995 | Yang | |
| 5,402,327 | A | 3/1995 | Gordin et al. | |
| D391,666 | S | 3/1998 | Lavy | |
| 5,734,229 | A | 3/1998 | Bavaro et al. | |
| 5,829,866 | A * | 11/1998 | Stegeman | 362/655 |
| 6,019,477 | A | 2/2000 | Wegrzyn et al. | |
| 6,019,481 | A | 2/2000 | Ambach et al. | |
| D427,350 | S | 6/2000 | Landefeld | |
| 6,155,693 | A | 12/2000 | Spiegel et al. | |
| D436,211 | S | 1/2001 | Neeld et al. | |
| D468,478 | S | 1/2003 | Landefeld et al. | |
| 6,533,446 | B2 | 3/2003 | Chen et al. | |
| D515,231 | S | 2/2006 | Randazzo et al. | |
| 7,083,315 | B2 | 8/2006 | Hansler et al. | |
| 7,296,908 | B1 | 11/2007 | Pickard et al. | |
| 7,425,084 | B2 | 9/2008 | Ruud et al. | |
| 2003/0202340 | A1 | 10/2003 | Wu | |
| 2007/0236946 | A1 | 10/2007 | Petrakis et al. | |

* cited by examiner

*Primary Examiner* — Stephen F Husar
*Assistant Examiner* — James W Cranson
(74) *Attorney, Agent, or Firm* — Alfred N. Goodman; Mark S. Bicks

(57) ABSTRACT

A lighting fixture having a housing with a main body, and a primary light source disposed beneath a cover secured thereto with a latching mechanism. The light fixture may include a reflector suspended above the main body on a pair of struts. The latching mechanism is engaged by pivoting at least one exterior wall of the housing to provide tool-less access to the light source. In an alternative embodiment, the main body attaches to a mounting arm and a wall mount housing with a secondary adjustable light source.

27 Claims, 9 Drawing Sheets

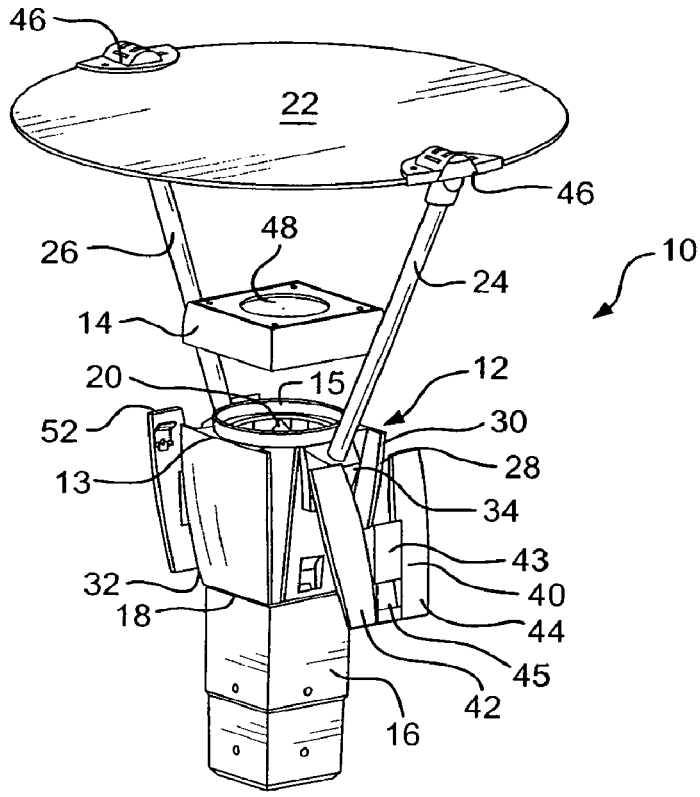
FIG. 1
FIG. 2
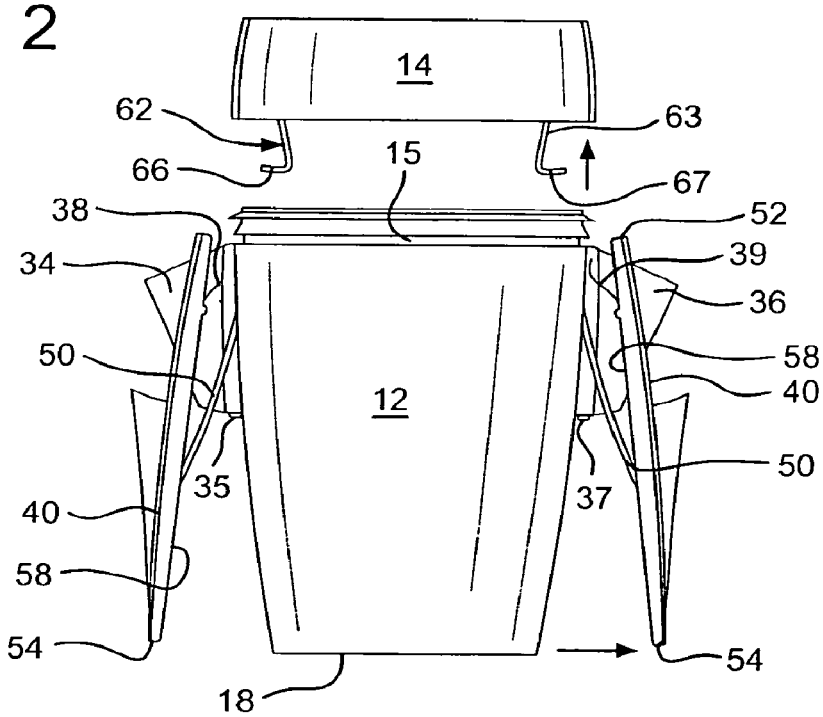

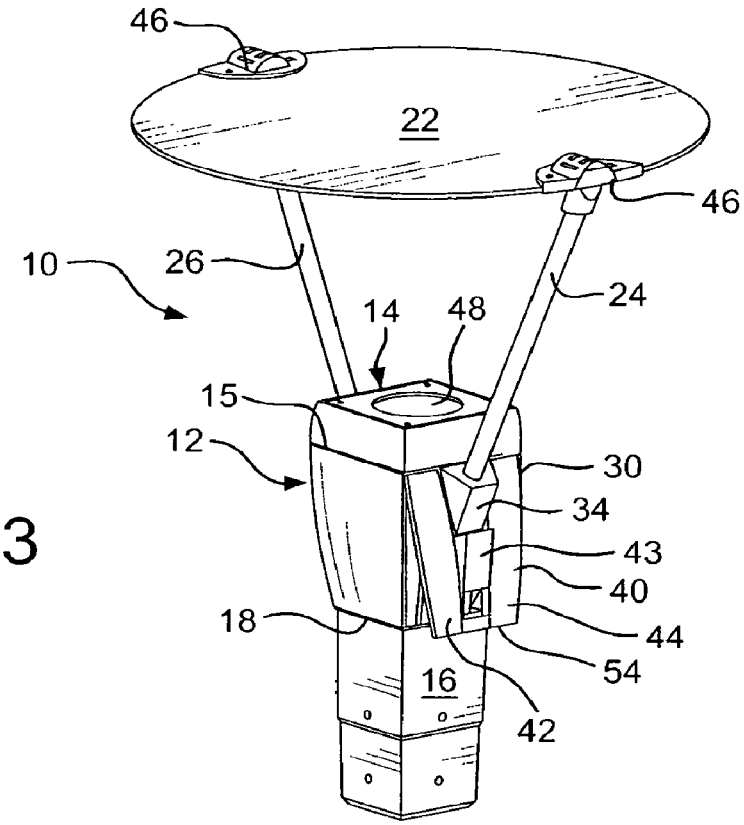
FIG. 3
FIG. 4
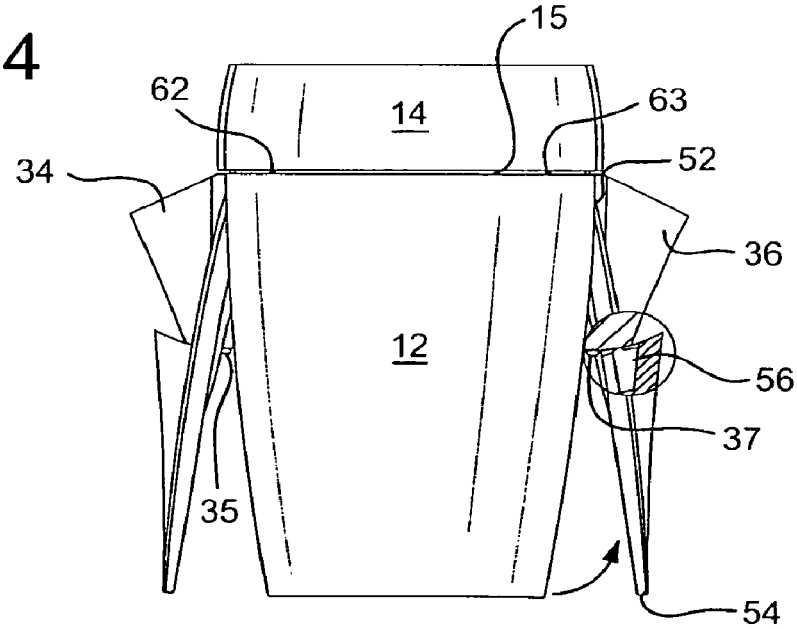

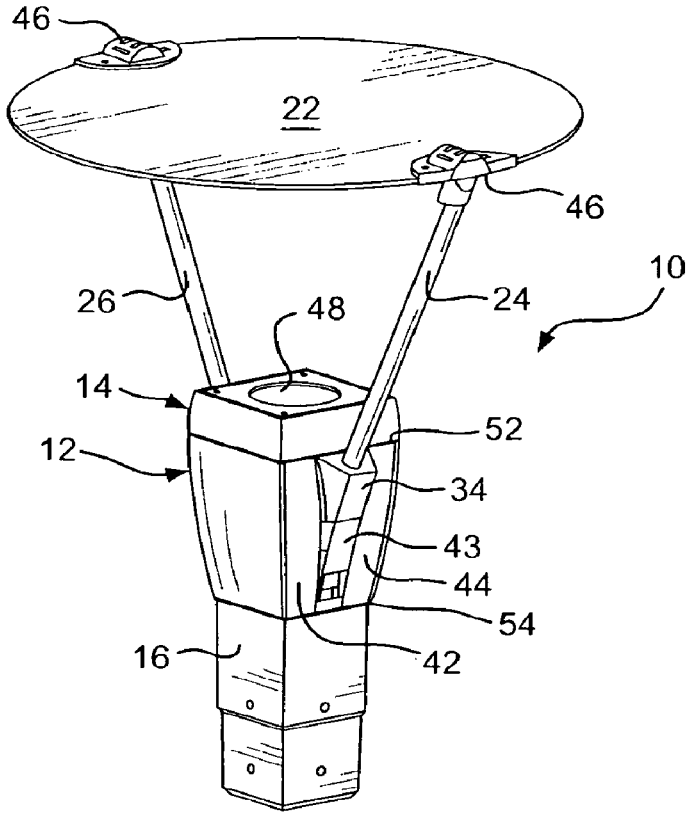
FIG. 5
FIG. 6
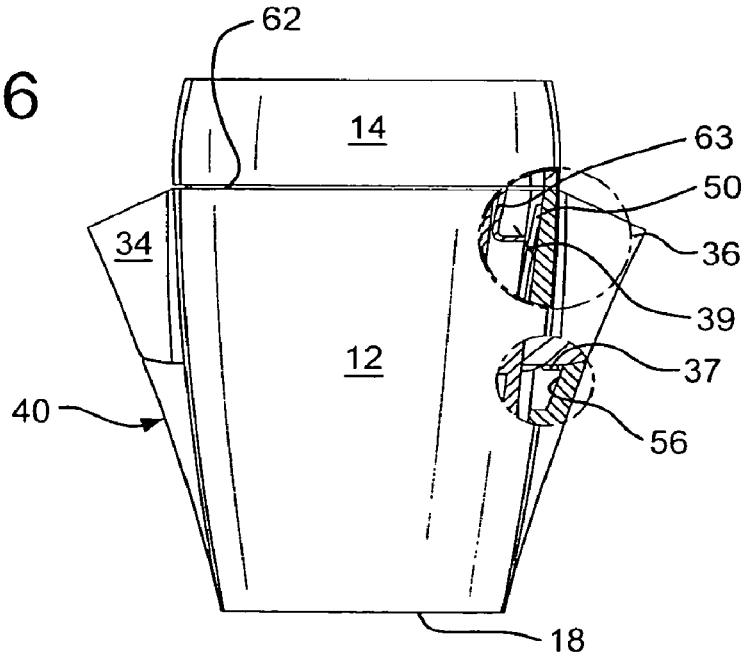

LIGHTING FIXTURE HAVING A LATCHING SYSTEM AND AN AUXILIARY EMERGENCY LIGHT

FIELD OF THE INVENTION

The present invention relates to lighting fixtures, in particular to lighting fixtures having a primary light source in a closed housing that can be opened for access to the light source; and to lighting fixtures of this type provided with a secondary light source.

BACKGROUND OF THE INVENTION

Accessing the primary light source of closed lighting fixtures, such as architectural fixtures, is usually a cumbersome task. Oftentimes, the light source is disposed behind a door or cover that requires tools for removal, and the cover and other parts can become separated from the fixture during the process. Darkness exacerbates the problem during relamping because most conventional lighting fixtures are not equipped with a backup light source that provides illumination when the primary light source fails. Accordingly, a need exists for providing a lighting fixture having a tool-less access to the light engine for replacing a lamp. Also, a need exists for providing a lighting fixture having a main light source in a primary location and a second auxiliary (e.g., emergency) light source in an alternate location that activates when the main light source fails.

SUMMARY OF THE INVENTION

Accordingly, an object of the present invention is to provide a lighting fixture having a primary light source contained in a main body and an auxiliary light source disposed in a housing to compensate for any failure of the primary light source.

Another object of the invention is to provide a lighting fixture having an external reflector for diffusing light that emerges from the fixture.

A further object of the invention is to provide a lighting fixture having a latch mechanism for securing the cover to the main body, allowing tool-less and efficient access to the primary light source contained therein.

Still another object of the invention is to provide a light fixture having pivotal walls forming parts of the latch mechanisms that provide access to the light source beneath the cover.

Yet another object of the invention is to provide a light fixture having a primary light source accessible with a tool-less latch mechanism and a readily accessible auxiliary light source in a wall mount housing.

Another object of the invention is to provide a light fixture having an easily adjustable auxiliary light source.

The foregoing objects are basically attained by providing, in one embodiment, a lighting fixture having a housing with a main body, a cover mounted thereon, and a lower support adjacent a bottom. The main body includes a socket for a light source, and may include a reflector disposed above the main body secured by two struts. A latch mechanism disposed on the main body connects the cover thereto by means of pairs of mating clasp elements. The latch mechanism engages at least one hook on the cover and includes walls of the main body that are hinged to the main body and can be rotated outwardly to unlatch the cover to allow access to the light source.

The foregoing objects concerning an auxiliary light source are basically attained by connecting the main body to a wall mount housing having a secondary adjustable light source.

The secondary light source is mounted on a movable bracket that is clamped by a threaded stud and a wingnut.

By forming the lighting fixture in this manner, a user has tool-less access to the interior of the main body and the light source. Other than the pivoting walls, the components of the latch mechanism are concealed when the walls are flush with the main body. By disengaging the latch mechanism, the walls rotate away from the main body to loosen the cover therefrom. Also, a user has easy access to the auxiliary light source by removing a separate cover.

As used in this application, the terms "top", "bottom", and "side" are intended to facilitate the description of the invention, and are not intended to limit the present invention to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure:

FIG. 1 is a front perspective view of the lighting fixture according to a first embodiment of the present invention with the cover disposed in an open position and the latch being disengaged;

FIG. 2 is a side elevational view of the lighting fixture according to FIG. 1 with the latch mechanism disengaged and the cover removed;

FIG. 3 is a front perspective view of the lighting fixture according to FIGS. 1 and 2 with the latch mechanism partially engaged;

FIG. 4 is a side elevational view with a partial cross-sectional view of the latch mechanism according to FIG. 3 with the latch mechanism partially engaged;

FIG. 5 is a front perspective view of the lighting fixture according to FIGS. 1-4 with the latch mechanism fully engaged and the cover disposed in a closed position;

FIG. 6 is a side elevational view with two partial cross-sectional views of the latch mechanism according to FIG. 5 with the latch mechanism fully engaged;

DETAILED DESCRIPTION OF THE INVENTION

Figure 7:
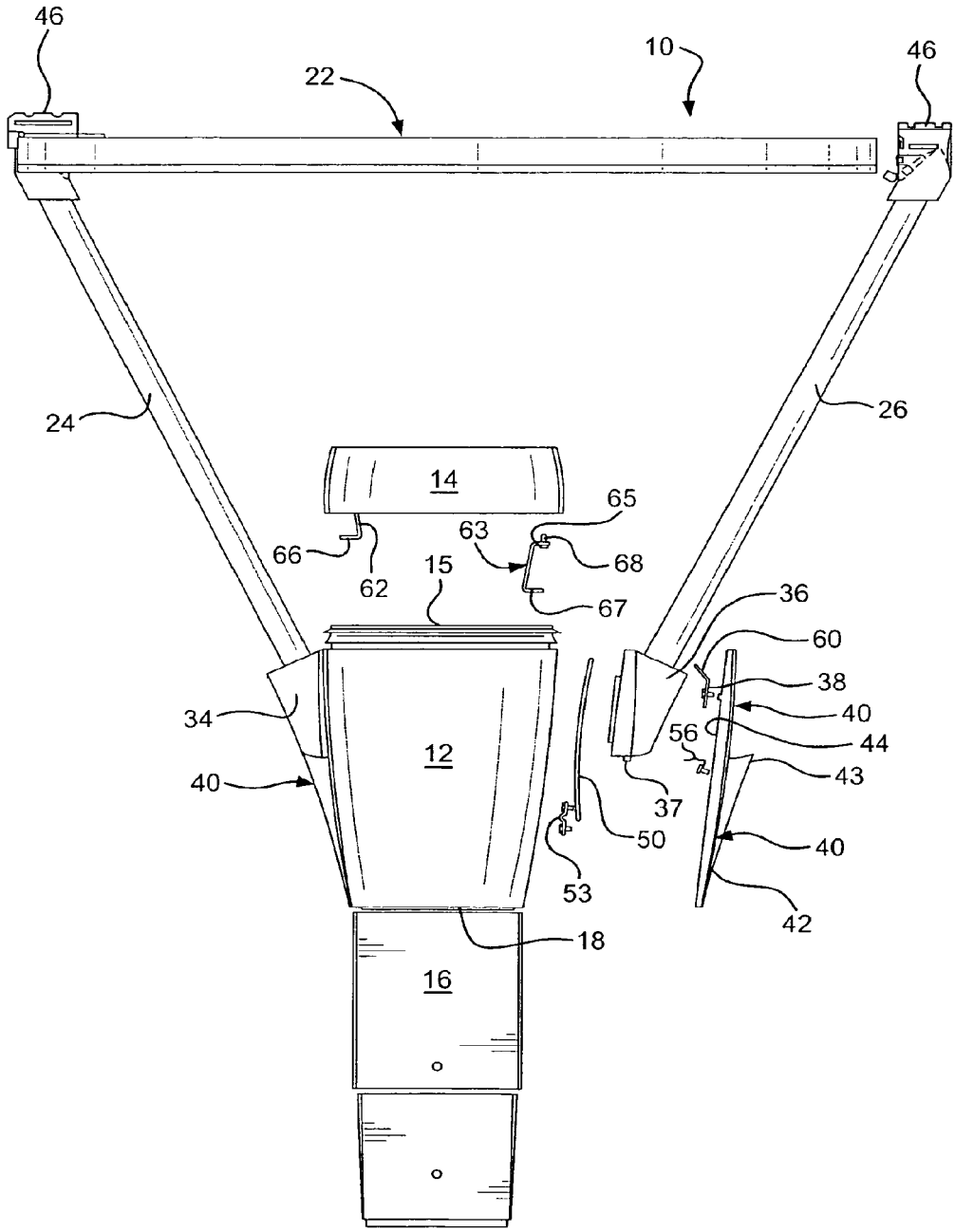
FIG. 7 is a side elevational view of the lighting fixture according to FIGS. 1-6 with an exploded view of the latch mechanism.

Turning to FIG. 1, a lighting fixture 10 includes a housing with a main body 12 containing a light source or lamp 20 beneath a cover 14. The cover 14 is mounted onto the main body 12 with a latching mechanism 28 having components attached to both the cover 14 and at least one wall 40 of the main body 12. An external reflector 22 is supported above the main body 12 with a first strut 24 protruding from the first side wall 30 and a second strut 26 protruding from a second side wall 32 of the main body 12. While the illustrated reflector is round and flat, other shapes and contours can be used depending on desired lighting effects.

The main body 12 is substantially rectangularly-shaped having a tapered bottom 18 opposite the top 15 adjacent the cover 14. The top 15 of the main body 12 is circular to match the lens 48 and open area of the cover 14. A sealing gasket 15*a* may be provided at the top 15. The tapered bottom 18 connects to a lower support portion 16 defined by a slightly narrower diameter than that of the main body 12. The lighting fixture 10 may be pole-mounted with the lower support 16 joined to a pole (not shown). The lighting fixture is illustrated as vertically oriented (i.e., with cover 14 on top); however, it can be oriented at other angles with appropriate mounts to achieve desired lighting effects in particular applications.

Light from the lamp 20 is transmitted through a lens 48 in the cover 14 and reflects off reflector 22 positioned directly above the cover 14. The source of the light 20 is preferably a light emitting diode (LED)-type lamp, but a fluorescent or an incandescent lamp can be used. The reflector 22 is secured to the lighting fixture 10 with struts 24, 26 protruding from angled supports 34, 36 adjacent the first side wall 30 and second side wall 32, respectively. The struts 24, 26 are secured to the reflective cover 22 with brackets 46 affixed to the outer circumference of the reflective cover 22. The reflective cover 22 is preferably circular to conform generally to the beam of light emerging from lens 48.

The lighting fixture 10 includes a latch mechanism 28 on first and second sides 30, 32 of the main body 12. Each latch mechanism 28 is primarily defined by the components of one wall 40 and first and second hooks 62, 63, which connect the cover 14 to the main body 12. Both latch mechanisms 28 preferably are undone to gain access to the interior cavity of the main body 12.

Figure 8:
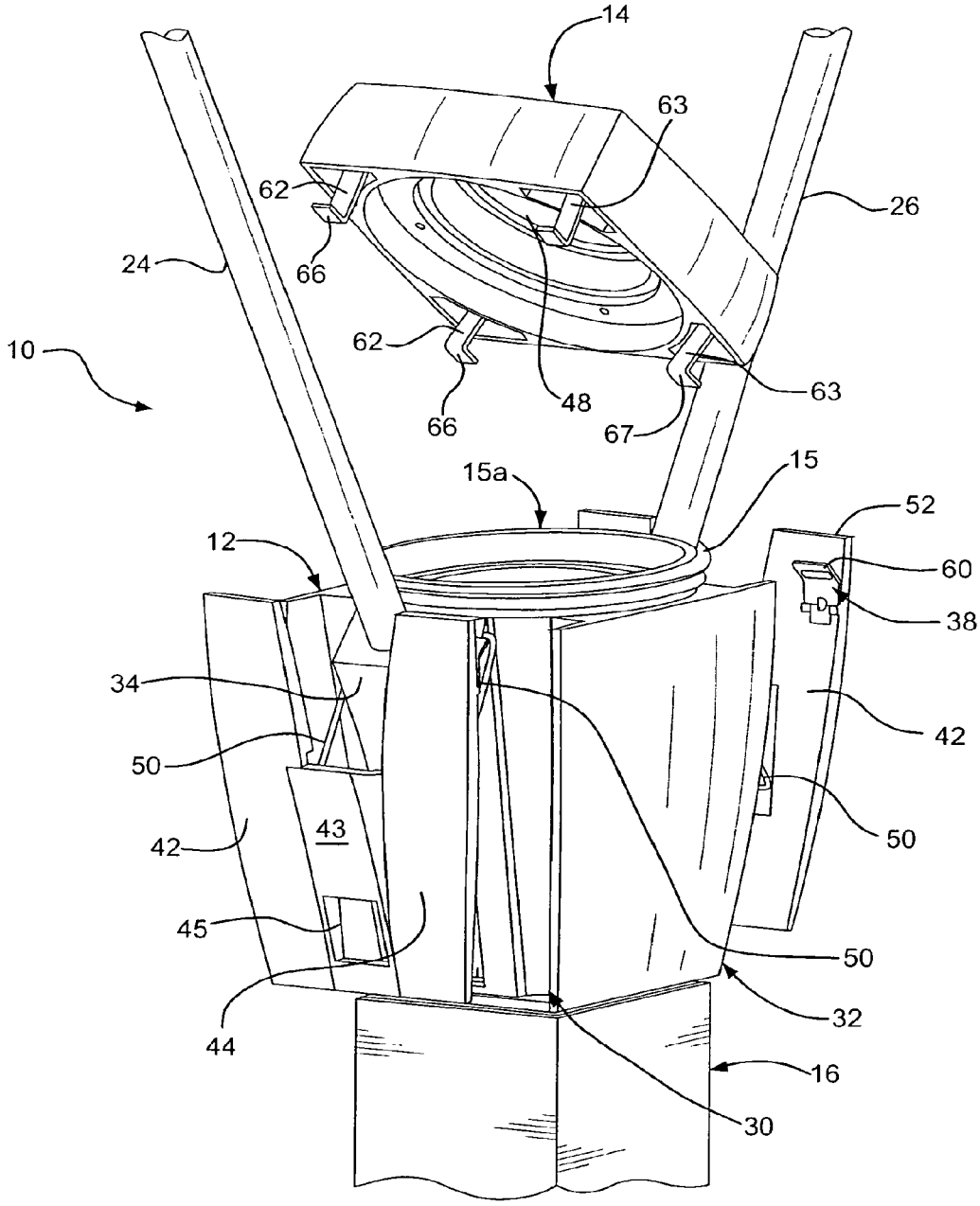
FIG. 8 is a side perspective view of the lighting fixture according to FIGS. 1-7 with the latch mechanism fully disengaged and the cover removed.
Figure 9:
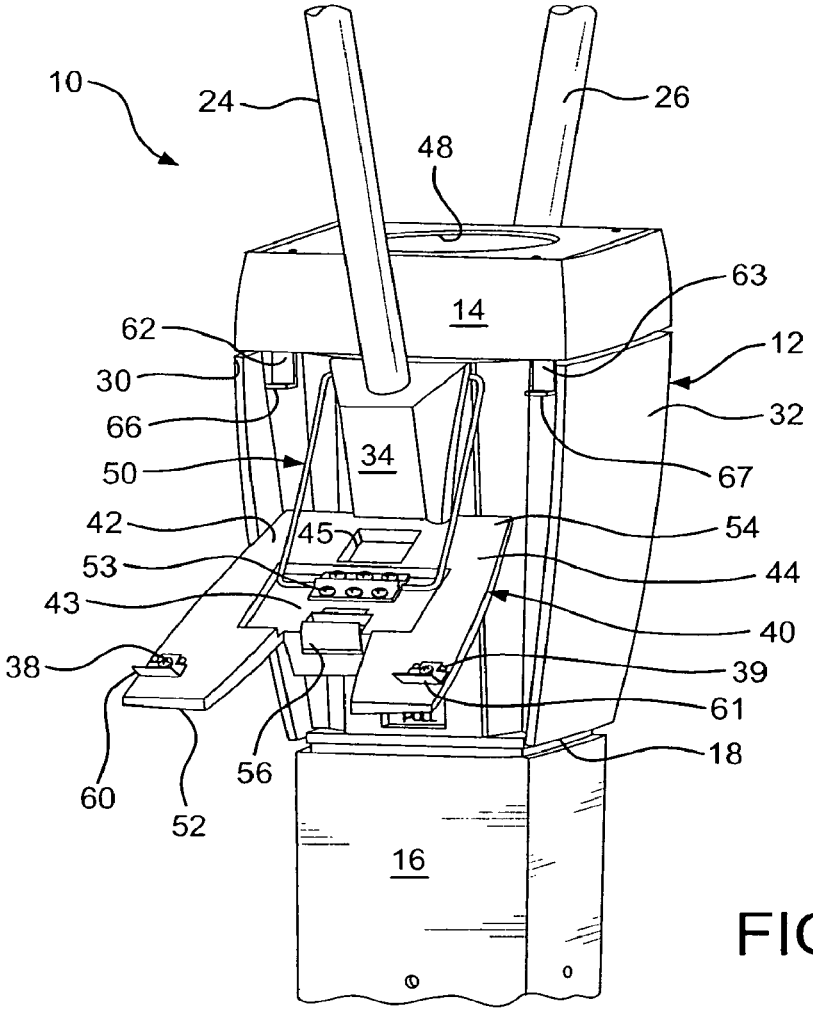
FIG. 9 is a side elevational view of the lighting fixture according to FIGS. 1-8 with an H-shaped wall fully rotated.

The first side 30 of the main body 12 and the second side 32 of the main body 12 each include a substantially H-shaped wall 40 that orbits or fits flush against the main body 12 when the cover 14 is secured to the top 15 of the main body 12 and the latch mechanism 28 is engaged. In this state, the upper end 52 is adjacent the main body top 15, and the bottom end 54 is adjacent the lower support 16, more specifically, adjacent the tapered bottom 18. As seen in FIGS. 8 and 9, each H-shaped wall 40 includes a first leg 42, a second leg 44 defining a notch therebetween, and a center portion 43 connecting the first leg 42 to the second leg 44, with a finger aperture 45 therein. The first leg 42 is equipped with a first catch 38 along the interior surface 58 of the wall 40, near the upper end 52. The second leg 44 is equipped with a second catch 39 along the interior surface 58, near the upper end 52. Each of the catches 38, 39 has an apertured angled portion 60, 61, respectively, that protrudes from the interior surface 58 of the wall 40, while the remaining portion of each catch 38, 39 is attached to the interior surface 58 with a screw.

Each H-shaped wall 40 is attached to the main body 12 by a wire-like hinge 50. At the first side 30, the hinge 50 hooks into and pivots about a first angled support 34 adjacent the top 15. Along the second side 32, the hinge 50 hooks into and pivots about a second angled support 36 adjacent the top 15. The hinge 50 is pivotally secured to the H-shaped wall 40 by bracket 53, which is screwed or riveted to wall 40. The hinge 50 allows the H-shaped wall 40 to rotate away from, and towards, the main body 12 without detaching therefrom, keeping the wall 40 stationary when the wall 40 has fully rotated away from the main body 12.

The first angled support 34 is fixed to the first side 30 of the main body 12. The shape of the support 34 resembles a truncated pyramid with a pin 35 along its bottom surface. The bottom portion of the first strut 24 is secured to the first angled support 34. Similarly, the second angled support 36 is fixed to the second side 32 of the main body 12. The shape of the support 36 represents a truncated pyramid with a pin 37 along its bottom surface.

The center 43 of each H-shaped wall 40 includes a resilient detent latch 56. The detent latch 56 is substantially L-shaped and protrudes from the interior surface 58 at approximately 90°. The detent latch 56 yieldably slides over the bottom of the angled supports 34, 36 when the H-shaped wall 40 is moved in or out relative to main body 12. More particularly, the detent latch 56 engages behind pins 35, 37 when the hinge 50 is adjacent to, or flush with, the interior of the main body 12. When the hinge 50 is extracted from the main body 12, the detent latch 56 yields enough to slide past the pin 35, 37, but the material is sturdy enough to lock against the interior side of the top support 34, 36 when the hinge 50 is flush with the first and second sides 30, 32.

The cover 14 is attached to the main body 12 by first and second hooks 62, 63 along each side 30, 32. The first hooks 62 engage the first catches 38 and the second hooks 63 engage the second catches 39. The hooks 62, 63 are essentially C-shaped (See FIG. 7) wherein the upper legs 64, 65 of the hooks 62, 63 are attached to the interior face of the cover 14 with screws 68. The lower legs 66, 67 of the hooks 62, 63 engage the apertures in the angled upper portions 60, 61 of the catches 38, 39. When the cover 14 is attached to the main body 12, the hinge 50 is adjacent to the interior of the main body 12 and the top end 52 of the H-shaped wall 40 is near the bottom edge of the cover 14 to enable the hooks 62, 63 to engage the catches 38, 39.

Figure 10:
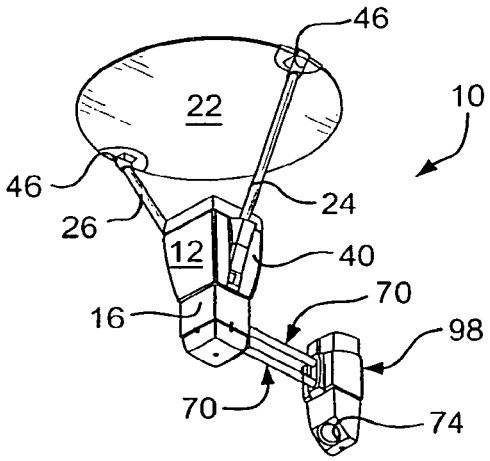
FIG. 10 is a bottom perspective view of the lighting fixture according to a second embodiment of the present invention with a mounting arm connecting the lighting fixture to a wall mount housing having an auxiliary light source.
Figure 11:
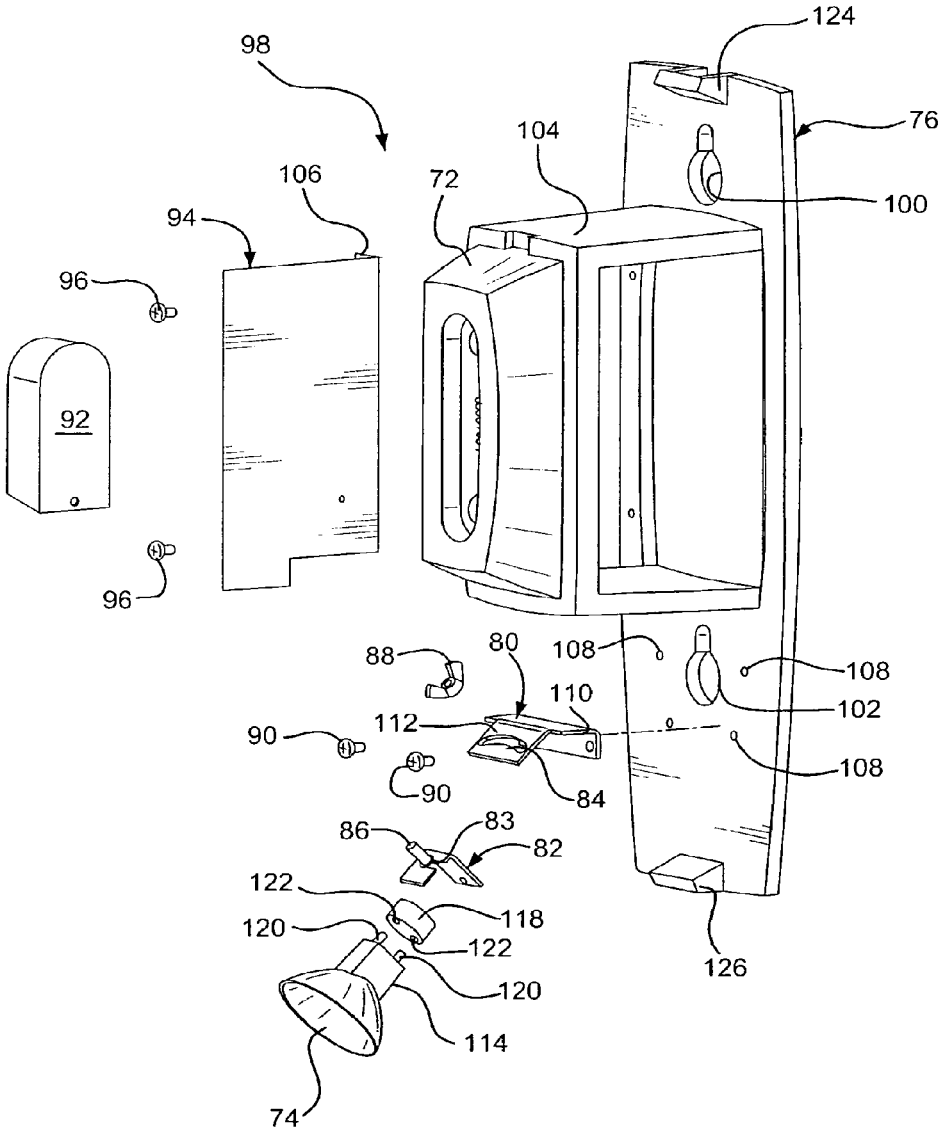
FIG. 11 is a side perspective view of the lighting fixture with an exploded view of the wall mount housing according to FIG. 10.

Turning to FIGS. 10 and 11, in this second embodiment, the lighting fixture 10 includes a secondary light source or lamp 74 contained within an easily accessible wall mount housing 98. The secondary light source 74 may be powered and controlled independently of the primary light source 20 described in the first embodiment. Preferably, the secondary light source 74 is not energized unless the building to which the housing 98 is attached activates its emergency lighting system. Both light sources 20, 74 can be activated simultaneously, but the preferable design of the lighting fixture 10 is for the secondary light source 74 to be activated when the primary light source 20 is unable to do so due to mechanical failures or the like.

Figure 12:
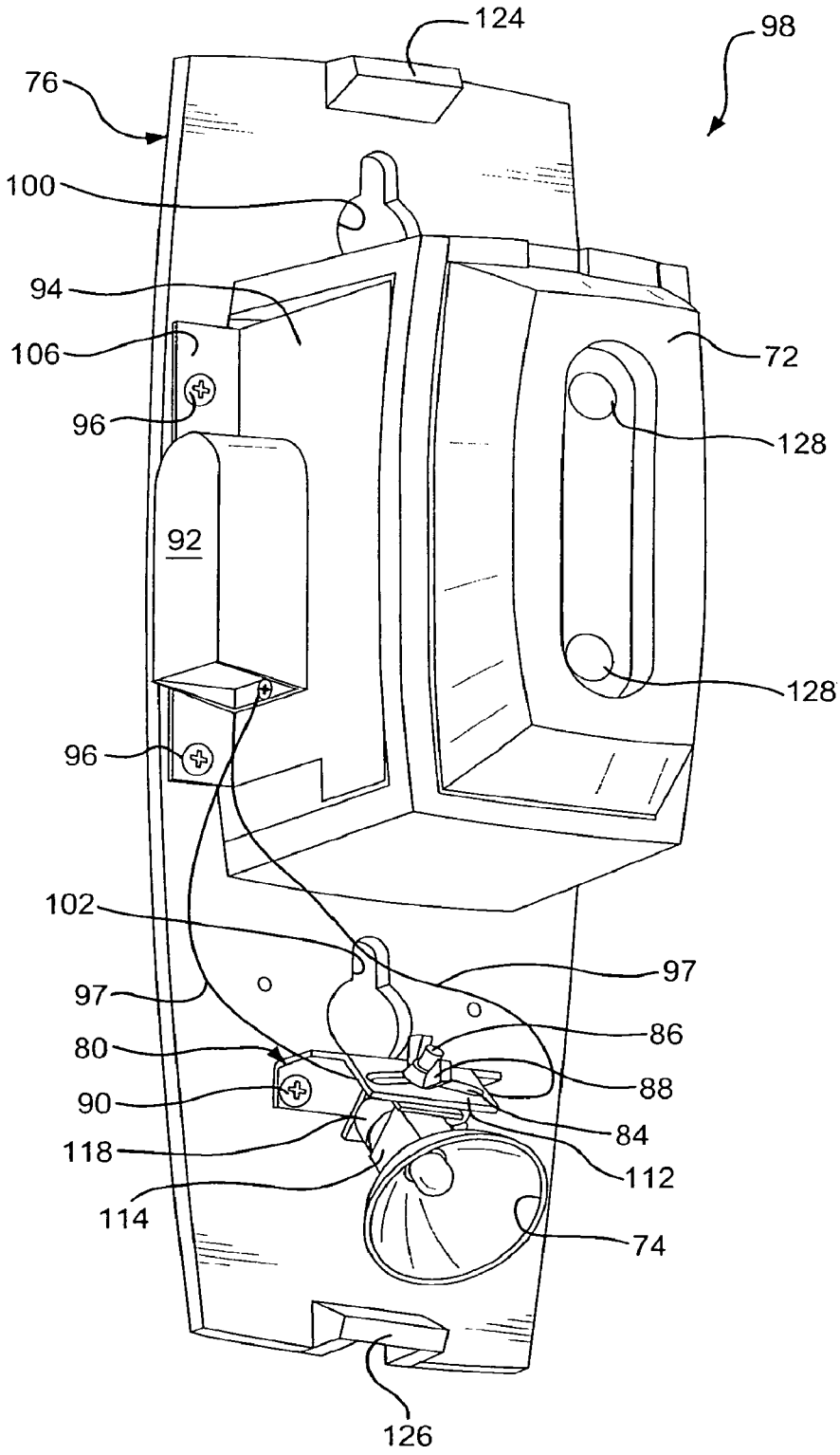
FIG. 12 is a side perspective view of the housing according to FIGS. 10 and 11 with the cover removed.
Figure 13:
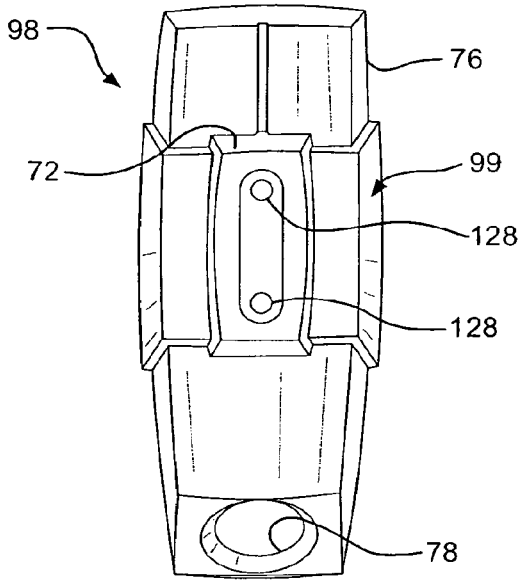
FIG. 13 is a front elevational view of the housing according to FIGS. 10-12.
Figure 14:
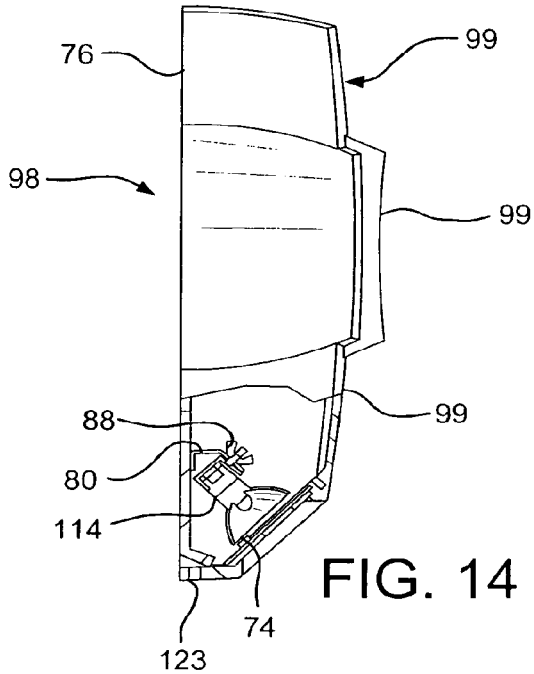
FIG. 14 is a side elevational view of the housing, partly in section, according to FIGS. 10-13.
Figure 15:
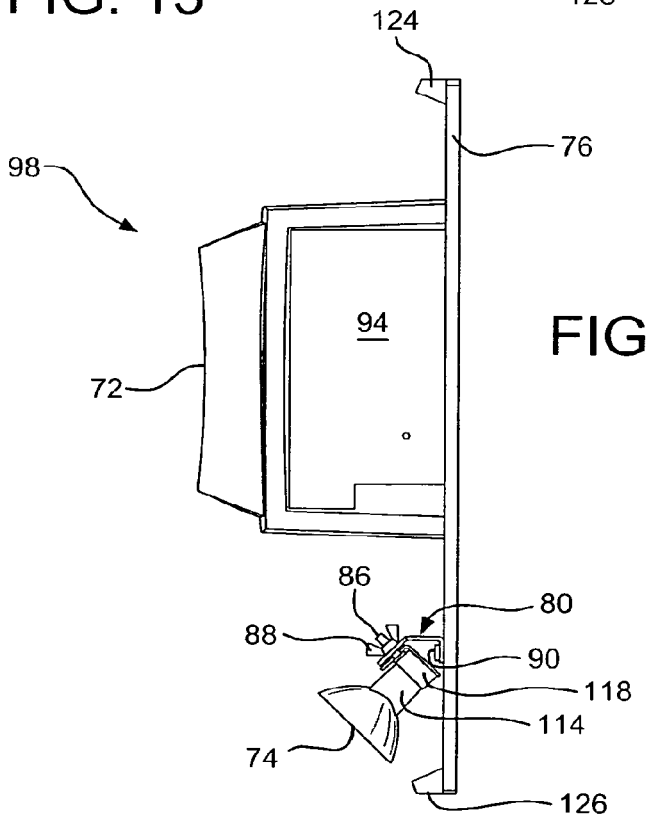
FIG. 15 is a side elevational view of the housing according to FIGS. 10-14 with the cover removed.

The main body 12 is attached to the wall mount housing 98 with mounting arms 70 therebetween. Specifically, the mounting arms 70 are secured to the lower support 16 adjacent a side of the lighting fixture 10 between the first and second sides 30, 32 so as not to interfere with the latch mechanism 28. The upper and lower mounting arms 70 connect to the wall mount housing 98 at the connection points 128 disposed along the wall face 72 (See FIG. 12).

The wall mount housing 98 is molded and includes a wall plate 76 attached to a wall or flat surface of a building. The wall plate 76 is substantially rectangular having an opening 100 above the wall face 72 and a second opening 102 below the wall face 72. The openings 100, 102 are key-shaped to receive screws or other mounting hardware to secure the wall plate 76 to a wall or flat surface. The wall plate 76 includes a top boss 124 and a bottom boss 126 protruding from the respective surfaces of the wall plate 76.

The entire wall plate 76 is covered by a cover 99, which is secured to the wall mount housing 98 by a top tab (not shown) that engages the recess in top boss 124, and a set screw 123 that engages the recess in bottom boss 126 of the wall plate 76. Beneath the cover 99, the wall plate 76 carries the secondary light source 74 and transformers. Light source 74 may be a 12V MR16 or MR11 reflector lamp, or any other type of lamp suitable for its purpose.

The main wall face 72 is substantially rectangular and is positioned towards the upper portion of the wall plate 76. Adjacent the wall face 72 is a transformer bracket 94 disposed along a longitudinal side 104 and mounted to the wall plate 76 with screws 96 through a lip 106. A low voltage transformer 92 is mounted on the face of the transformer bracket 94. The low voltage transformer 92 is substantially rectangular with an arcuate end facing the upper end of the wall plate 76. The low voltage transformer 92 provides power to the secondary light source 74 via leads 97.

Beneath the wall face 72, the secondary light source 74 is mounted to the wall plate 76. Specifically, an adjustment bracket 84 is mounted to the wall plate 76 beneath the second opening 102. Screws 90 secure the adjustment bracket 84 to holes 108 adjacent the second opening 102. The adjustment bracket 80 has three surfaces including an L-shaped component 110 formed by two surfaces, and an angled component 112 having an arcuate slot 84 that spans about 30 degrees.

A socket bracket 82 attaches to the adjustment bracket 84 with a threaded stud 86. The stud 86 and an adjacent alignment tab 83 are received in the channel 84 from beneath the angled component 112, and is secured in a selected position by a wing nut 88 on the top of the angled component 112. Socket bracket 82 carries a bi-pin socket 118 having openings 122 that receive the pins 120 protruding from the base 114 of the lamp 74.

To access the primary light engine or LED 20, the latching mechanisms 28 are undone to remove the cover 14 from the main body 12 of the lighting fixture 10. For simplicity, only the latching mechanism 28 along a first side 30 of the lighting fixture 10 will be described. First, the finger aperture 45 is manually engaged to pull the bottom portion of H-shaped wall 40 away from the main body portion 12 (See FIG. 3). This action releases the detent latch 56 from the pin 35 beneath the first angled top support 30, allowing the wall 40 to move down. This disengages catches 38, 39 from hooks 62, 63.

The top end 52 can then be rotated away from the top 15 of the main body 12 until the bottom end 54 rests beneath the angled support 30 (See FIG. 9). After the same operation is performed on the opposite side 32 with the opposing H-shaped wall 32, all of the latches 62, 63 are disengaged, freeing the cover. The cover 14 is then removed, providing access to the light engine.

To fully engage the latching mechanisms, the reverse is performed. The cover 14 is positioned along the top 15 of the main body 12 to create a sealed chamber for the light engine 20. The H-shaped wall 40 is rotated inwardly towards the main body 12. The top end 52 is tilted in so that the catches 38, 39 engage hooks 62, 63 on the cover. Then the wall 40 is pressed inwardly until the detent latch 56 snaps past the pin 35 beneath the angled support 34. This pulls down on the hooks 62, 63, creating a compression seal between the cover 14 and main body 12.

While a particular embodiment has been chosen to illustrate the invention, it will be understood by those skilled in the art that various changes and modifications can be made therein without departing from the scope of the invention as defined in the appended claims.

What is claimed is:

1. A lighting fixture comprising:

a housing comprising a body with an opening, a light-transmitting cover removably secured to the body over the opening, a mounting portion for securing the lighting fixture to a support, and at least one exterior wall hinged to the body for movement between a body-abutting position and an extended position;

a socket in the body for supporting and providing electric power to a light source; and at least one latching mechanism carried by the body for removably securing the cover to the body, the latching mechanism comprising said exterior wall and at least one pair of mating clasp elements carried by the cover and by the exterior wall.

2. The lighting fixture according to claim 1, wherein the clasp elements are concealed when engaged and when the exterior wall abuts the body.

3. The lighting fixture according to claim 1, wherein the latching mechanism compresses the cover against the body when fully latched.

4. The lighting fixture according to claim 3, comprising a gasket between the cover and the body.

5. The lighting fixture according to claim 1, wherein the latching mechanism comprises a hinge link pivoted at one end to the body and pivoted at the other end to the exterior wall.

6. The lighting fixture according to claim 5, wherein the hinge link is adapted to hold the exterior wall in the extended position.

7. The lighting fixture according to claim 5, wherein the hinge link is concealed when the exterior wall is in its body-abutting position.

8. The lighting fixture according to claim 5, wherein the latching mechanism comprises cooperating detent elements on the exterior wall and on the body adapted to maintain the exterior wall in its body-abutting position.

9. The lighting fixture according to claim 8, wherein the hinge link is pivoted to the body between the detent elements and the cover, and is pivoted to the exterior wall between the detent elements and the end of the exterior wall remote from the cover.

10. The lighting fixture according to claim 8, comprising an externally engageable finger pull near the end of the exterior wall remote from the cover for pulling the exterior wall away from the body to initiate unlatching.

11. The lighting fixture according to claim 5, wherein the hinge link comprises a pair of spaced, substantially parallel members.

12. The lighting fixture according to claim 1, wherein the clasp element carried by the cover comprises a hook, and the clasp element carried by the exterior wall comprises an aperture adapted to receive the hook.

13. The lighting fixture according to claim 1, comprising two pair of mating clasp elements carried by the cover and by the exterior wall.

14. The lighting fixture according to claim 1, comprising two latching mechanisms on opposite sides of the body, each latching mechanism comprising an exterior wall hinged to the body for movement between a body-abutting position and an extended position, and at least one pair of mating clasp elements carried by the cover and by the exterior wall.

15. The lighting fixture according to claim 14, further comprising a reflector supported on the body and disposed above the cover.

16. The lighting fixture according to claim 15, wherein the reflector is supported on two struts at said opposite sides of the body, and each strut is anchored in a body-mounted support extending through a notch in the upper edge of the exterior wall.

17. The lighting fixture according to claim 1, further comprising a wall mount having a socket for holding and powering a second light source, and a mounting arm connecting the mounting portion of the body to the wall mount.

18. A lighting fixture comprising:

a housing comprising a body with an opening, a light-transmitting cover removably secured to the body over the opening, and a mounting portion for securing the lighting fixture to a support;

a socket in the body for supporting and providing electric power to a light source;

a reflector supported on the body and disposed above the cover; and at least one latching mechanism carried by the body for removably securing the cover to the body.

19. The lighting fixture according to claim 18, wherein the reflector is supported on two struts at said opposite sides of the body, and a latching mechanism is disposed on each of said opposite sides of the body.

20. The lighting fixture according to claim 18, wherein each strut is anchored in a body-mounted support on each of said opposite sides of the body.

21. The lighting fixture according to claim 18, wherein the reflector is substantially circular.

22. The lighting fixture according to claim 18, wherein the cover includes a substantially circular lens adapted to transmit light from the light source.

23. The lighting fixture according to claim 18, further comprising a wall mount having a socket for holding and powering a second light source, and a mounting arm connecting the mounting portion of the body to the wall mount.

24. The lighting fixture according to claim 23, wherein the position of the second light source is adjustable.

25. The lighting fixture according to claim 24, wherein the socket for the second light source is adjustably mounted for arcuate movement through about 30 degrees.

26. The lighting fixture according to claim 23, wherein the wall mount comprises a wall plate supporting the mounting arm and adapted for securement to a wall, and a cover removably secured to the wall plate.

27. The lighting fixture according to claim 26, wherein the cover has an opening through which the mounting arm extends, and an aperture through which light from the second light source projects.

* * * * *